US008911875B2

(12) United States Patent
Kennedy et al.

(10) Patent No.: US 8,911,875 B2
(45) Date of Patent: Dec. 16, 2014

(54) SLIDING ELEMENT HAVING ADJUSTABLE PROPERTIES

(75) Inventors: Marcus Kennedy, Dusseldorf (DE); Michael Zinnabold, Burscheid (DE); Marc-Manuel Matz, Friedberg (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 628 days.

(21) Appl. No.: 13/260,107

(22) PCT Filed: Nov. 23, 2009

(86) PCT No.: PCT/EP2009/008333

§ 371 (c)(1),
(2), (4) Date: Aug. 22, 2012

(87) PCT Pub. No.: WO2010/115448

PCT Pub. Date: Oct. 14, 2010

(65) Prior Publication Data

US 2012/0306158 A1 Dec. 6, 2012

(30) Foreign Application Priority Data

Apr. 7, 2009 (DE) ..... 10 2009 016 650

(51) Int. Cl.

| | |
|---|---|
| ***B22F 1/00*** | (2006.01) |
| ***B32B 15/04*** | (2006.01) |
| ***B32B 5/14*** | (2006.01) |
| ***B32B 7/02*** | (2006.01) |
| ***B32B 9/00*** | (2006.01) |
| ***F16C 33/04*** | (2006.01) |
| ***C23C 4/06*** | (2006.01) |
| ***C23C 28/02*** | (2006.01) |
| ***C23C 28/00*** | (2006.01) |

(52) U.S. Cl.

CPC ..... *C23C 4/06* (2013.01); *C23C 28/021* (2013.01); *C23C 28/023* (2013.01); *C23C 28/321* (2013.01); *C23C 28/322* (2013.01); *C23C 28/324* (2013.01); *C23C 28/341* (2013.01); *C23C 28/347* (2013.01); *C23C 28/36* (2013.01)

USPC ..... 428/552; 428/565; 428/610; 428/615; 428/656; 428/217; 428/469; 428/698; 508/105; 508/109

(58) Field of Classification Search

None

See application file for complete search history.

(56) References Cited

U.S. PATENT DOCUMENTS 3,725,017 A 4/1973 Prasse
4,064,608 A * 12/1977 Jaeger ..... 492/54

(Continued)

FOREIGN PATENT DOCUMENTS

DE 10163976 A1 7/2003
DE 102007025949 A1 11/2008

(Continued)

*Primary Examiner* — Gwendolyn Blackwell
*Assistant Examiner* — Seth Dumbris
(74) *Attorney, Agent, or Firm* — Robert L. Stearns; Dickinson Wright, PLLC

(57) ABSTRACT

A sliding element, particularly a piston ring for an internal combustion engine, includes a substrate, and a wear-protection layer, obtained by thermal spraying of a powder comprising the element proportions 2-50 percent by weight iron, FE;
5-60 percent by weight tungsten, W;
5-40 percent by weight chrome, Cr;
5-25 percent by weight nickel, Ni;
1-5 percent by weight molybdenum, Mo;
1-10 carbon, C and
0.1-2 percent by weight silicon, Si;

and a running-in layer, obtained by thermal spraying of a powder comprising the element proportions 60-95 percent by weight nickel;
5-40 percent by weight carbon.

17 Claims, 1 Drawing Sheet

(56) References Cited

U.S. PATENT DOCUMENTS

| | | | | | |
|---|---|---|---|---|---|
| 4,243,414 | A * | 1/1981 | Takahashi et al. | ..... | 75/244 |
| 4,822,415 | A * | 4/1989 | Dorfman et al. | ..... | 420/61 |
| 6,887,585 | B2 * | 5/2005 | Herbst-Dederichs | ..... | 428/546 |
| 2007/0099014 | A1 * | 5/2007 | McCullough et al. | ..... | 428/469 |

FOREIGN PATENT DOCUMENTS

| | | | | | |
|---|---|---|---|---|---|
| DE | 102007025949 | * | 12/2008 | ..... | C23C 28/00 |
| DK | WO 98/19084 | * | 5/1998 | ..... | F16J 9/26 |
| EP | 1055351 | A1 | 11/2000 | | |
| WO | WO2008008373 | A1 | 1/2008 | | |

* cited by examiner

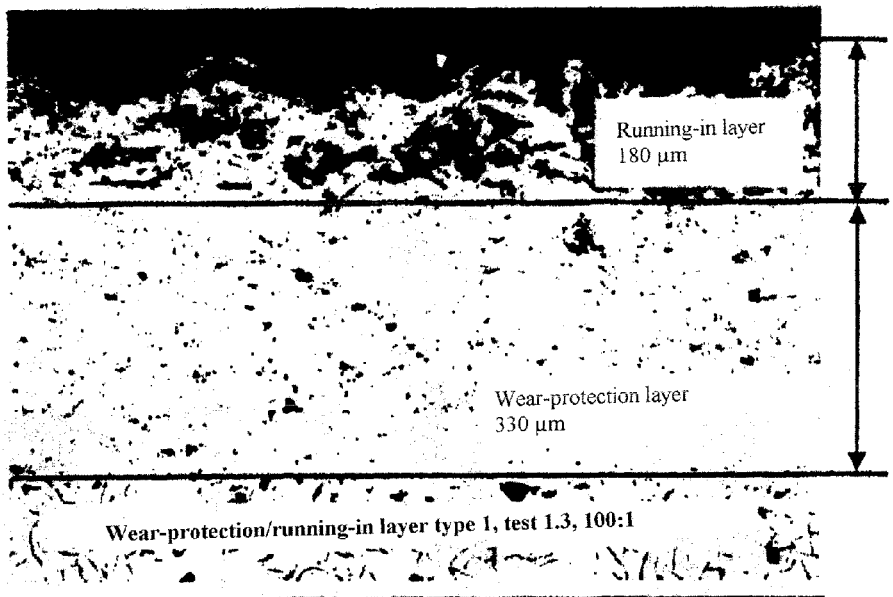
Wear-protection/running-in layer type 1, test 1.3, 100:1
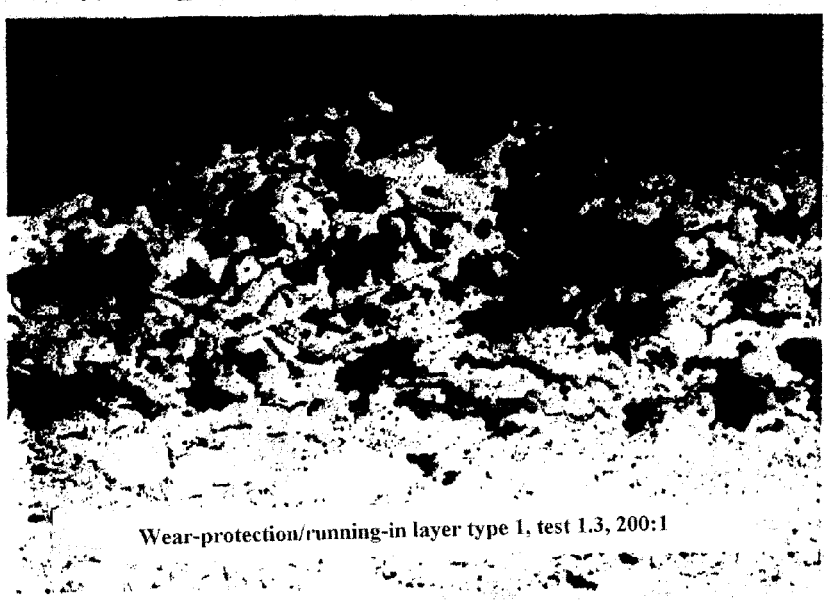
Wear-protection/running-in layer type 1, test 1.3, 200:1

SLIDING ELEMENT HAVING ADJUSTABLE PROPERTIES

BACKGROUND OF THE INVENTION

1. Technical Field

The present invention relates to a sliding element, particularly a piston ring, with adjustable properties, particularly in relation to wear behaviour, and also a method of producing it.

2. Related Art

Nowadays customer requirements in relation to wear behaviour on the piston ring and the cylinder barrel differ. On the one hand, the least possible wear is required, while on the other hand, engine manufacturers also need higher wear rates, in order to obtain what is from their point of view the best possible running-in performance for the "piston ring/cylinder liner" system. This is becoming an increasingly common problem in the 2-stroke engines sector (ring diameters >430 mm).

Iron-based coatings applied by means of thermal spraying are not yet used on the piston ring. Only iron-based coatings on the cylinder barrel have been known to date in the crank drive sector, said coatings being produced by means of electric arc wire spraying (EP 1 055 351 B2). The production of anti-wear layers by means of the thermal spraying process is a known method. The powder materials used for this currently are Mo, WC, NiCr and $Cr_3C_2$.

SUMMARY OF THE INVENTION

The invention therefore addresses the following problems. On the one hand, an improvement in the tribological properties of thermally sprayed piston rings using a hitherto unused material system as the coating material, compared with traditional Mo-based piston ring coatings. Furthermore, the production of coated piston rings meeting customer requirements, which are customised in relation to their wear performance and intrinsic stresses, wherein the coating is achieved by thermal spraying. In addition, the running-in performance is to be optimised. The basic material matrix should preferably exhibit similar physical properties (thermal expansion coefficient and heat conductivity) to the underlying substrate and sufficient mechanical properties (hardness, ductility).

In accordance with a first aspect of the invention, a sliding element is provided, particularly a piston ring for an internal combustion engine, comprising a substrate and a wear-protection layer, obtained by thermal spraying of a powder comprising the element proportions 2-50 percent by weight iron, FE;

5-60 percent by weight tungsten, W;

5-40 percent by weight chrome, Cr;

5-25 percent by weight nickel, Ni;

1-5 percent by weight molybdenum, Mo;

1-10 carbon, C and 0.1-2 percent by weight silicon, Si;

and a running-in layer, obtained by thermal spraying of a powder comprising the element proportions 60-95 percent by weight nickel;

5-40 percent by weight carbon.

In order to solve the problem described above, a layer system must be produced comprising a basic system with similar physical properties to the substrate being coated and sufficient strength, combined with a wear-resistant proportion, wherein different wear rates on the ring and liner result in the lubricated state, depending on the proportions used. Likewise, the nature and strength of the residual stresses can be adjusted through the addition of defined quantities of the wear-resistant proportion. In principle, no residual tensile stresses are desirable in the thermally sprayed layers, because these are unable to reduce the crack propagation of an existing crack or may even increase it. The solution is a new Fe-based system, which is reinforced by carbides, coupled with a running-in layer suited to the needs of the engine manufacturers.

In relation to physical properties (heat conductivity, thermal expansion coefficient), a quasi-homogeneous system between the substrate and the coating is produced by a minimum proportion of the ferrous base system of 25% by weight. In this way, the thermal energy produced during the mixed friction, particularly in the top dead centre or bottom dead centre range, can be more effectively dissipated and a uniform thermal relaxation process guaranteed through the temperature fluctuations present in the engine. The use of Fe-based alloys as the piston ring base coating material along with a carbide system and a running-in layer (graded or ungraded), produced by means of thermal spraying, results in a new type of piston ring. The piston ring being coated may be a cast-iron or a steel piston ring in this case.

In accordance with one embodiment, the new material system consists of the following elements: iron (Fe), tungsten (W, as WC), chrome (Cr, as Cr and $Cr_3C_2$), nickel (Ni), molybdenum (Mo), silicon (Si) and carbon (C, partly bonded in Fe, W and Cr as carbide or in pure form, electrochemically encased in nickel).

In accordance with one embodiment, the proportion of carbides is 10-75 percent by weight, made up of 0-60 percent by weight tungsten carbide, WC and 0-50 percent by weight chrome-carbide, $Cr_3C_2$.

The iron-based alloy without carbides is not recommended, since the wear resistance (measured as described below) does not satisfy today's needs. An increase in the overall carbide content above 75% by weight is not recommended for use as a carbide ring coating, because if the proportion of carbide is too great, the layer takes on too great a ceramic character (modulus of elasticity too high) and cannot therefore withstand the temperature change stresses in the engine.

In accordance with one embodiment, the sliding element also comprises a transitional layer between the wear-protection layer and the running-in layer, wherein the chemical composition of the transitional layer exhibits a graduation ratio of 20:80 to 80:20, relative to the wear-protection layer and the running-in layer.

The chemical composition in the graduation ratio is adjustable to 20:80 to 80:20 for the single layer types wear-protection layer:running-in layer.

Example 1

$1^{st}$ layer: wear-protection layer $2^{nd}$ layer: on the wear-protection layer side, the chemical composition of the transitional layer is 80% like the composition of the wear protection layer, 20% like the running-in layer, while towards the running-in layer side there is an essentially linear transition to a composition that is 20% like the composition of the wear-protection layer and 80% like the composition of the running-in layer $3^{rd}$ layer: running-in layer

Example 2

$1^{st}$ layer: wear-protection layer $2^{nd}$ layer: chemical composition 20% like the wear-protection layer, 80% like the running-in layer, linear transition up to 80% like the wear-protection layer, 20% like the running-in layer $3^{rd}$ layer: running-in layer In accordance with one embodiment, the layer thickness of the wear-protection layer falls in the range 100-800 μm, preferably 200-600 μm and most preferably 300-500 μm.

In accordance with one embodiment, the layer thickness of the running-in layer falls in the range 100-500 μm, preferably 200-400 μm and most preferably 150-300 μm.

In accordance with one embodiment, the layer thickness of the transitional layer, in which the wear-protection and running-in layers are present in graded form, falls in the range 0-600 μm and most preferably 0-250 μm.

In accordance with one embodiment, the substrate is a ring with a diameter greater than 220 mm, preferably greater than 430 mm and maximum 980 mm.

In accordance with one embodiment, the particle sizes of the powder fall in the range 1-100 μm.

In accordance with one embodiment, the carbides are embedded in a nickel-chrome matrix and exhibit a particle size of 0.5-5 μm.

BRIEF DESCRIPTION OF THE DRAWING

FIG. 1 shows the microstructure of a thermally sprayed wear-protection/running-in layer according to one embodiment of the invention.

DETAILED DESCRIPTION

Tests Conducted:

The powder was thermally sprayed and the chemical composition (Table 1), the carbide content (Table 2), the microstructure (FIG. 1), the porosity and hardness (Table 3) were tested for different variants. Test 1 and 2 differ in that layer type 1 was produced in test 1 and layer type 2 in test 2. For tests 1.1 to 1.4 and 2.1 to 2.4 different carbide concentrations were set. The top layer in each case contains no carbides, as this layer is used for controlled running-in.

TABLE 1

Chemical composition of wear-protection/running-in layer type 1

| Test # | Carbide content (% by wt.) | Chemical composition Fe | W | Cr (% by wt.) | Ni | Mo | C | Si | Ni (% by wt.) | C |
|---|---|---|---|---|---|---|---|---|---|---|
| 1.1 | 0 | 47.5 | 0 | 28 | 17 | 4.6 | 1.8 | 1.1 | 70 | 30 |
| 1.2 | 20 | 35.7 | 11.2 | 30.2 | 15.2 | 3.8 | 3.1 | 0.8 | 70 | 30 |
| 1.3 | 40 | 23.9 | 22.5 | 33.2 | 12.4 | 2.6 | 4.9 | 0.5 | 90 | 10 |
| 1.4 | 60 | 11.4 | 33.8 | 34.8 | 11.7 | 2.3 | 5.7 | 0.3 | 90 | 10 |

TABLE 2

Carbide content of wear-protection/running-in layer type 1

| Test # | Carbide content (% by wt.) | Individual carbides: Wear-protection layer WC | Cr3C2 (% by wt.) | Running-in layer Total carbides |
|---|---|---|---|---|
| 1.1 | 0 | 0 | 0 | 0 |
| 1.2 | 20 | 9 | 13 | 0 |
| 1.3 | 40 | 17.5 | 25 | 0 |
| 1.4 | 60 | 26 | 37.5 | 0 |

The microstructure photographs (FIG. 1) show evenly distributed carbides for the wear-protection layer, no unmelted particles and a very dense layer with a very low porosity of <2%. The graphite depositions are clearly visible in the top layer. The layer thickness of the wear-protection layer is 330 μm, that of the running-in layer 180 μm.

TABLE 3

Hardness/porosity of wear-protection layer type 1

| Test # | Target carbide content (% by wt.) | HV1 | Porosity % |
|---|---|---|---|
| 1.1 | 0 | 520 | <1 |
| 1.2 | 20 | 564 | <1 |
| 1.3 | 40 | 597 | <1 |
| 1.4 | 60 | 710 | <2 |

As shown in Table 3, initial tests have shown that the wear-protection layer type 1 has a porosity of <1-2% with a hardness of roughly 520HV1 for the carbide-free Fe-base material up to 710HV1 for the Fe base material with a carbide content of 60% by weight. The hardness of the running-in layer cannot be determined due to the high graphite content.

The addition of carbides enables there to be a selective hardness setting on the ring and the cylinder barrel. In addition, the microstructure is largely retained, despite high loads during the wear test, which points in principle to a wear-resistant piston ring for the "ring/liner lubricated" system produced with this coating according to the invention, since the running-in process is complete.

What is claimed is:

1. A sliding element for an internal combustion engine, comprising a substrate and a wear-protection layer, obtained by thermal spraying of a powder comprising the element proportions 11.4-23.9 percent by weight iron, FE;

22.5-33.8 percent by weight tungsten, W;

33.2-34.8 percent by weight chrome, Cr;

11.7-12.4 percent by weight nickel, Ni;

2.3-2.6 percent by weight molybdenum, Mo;

4.9-5.7 percent by weight carbon, C and 0.3-0.5 percent by weight silicon, Si;

40-60 percent by weight carbides;

and a running-in layer, obtained by thermal spraying of a powder comprising the element proportions 90 percent by weight nickel;

10 percent by weight carbon.

2. The sliding element according to claim 1, further comprising a transitional layer between the wear-protection layer and the running-in layer, wherein the chemical composition of the transitional layer exhibits a graduation ratio of 20:80 to 80:20, relative to the wear-protection layer and the running-in layer.

3. The sliding element according to claim 1, wherein the carbides are made up of 17.5-26 percent by weight tungsten carbide, (WC) and 25-37.5 percent by weight chrome-carbide ($Cr_3C_2$).

4. The sliding element according to claim 1, wherein the layer thickness of the wear-protection layer falls in the range 100-800 μm.

5. The sliding element according to claim 1, wherein the layer thickness of the running-in layer falls in the range 100-500 μm.

6. The sliding element according to claim 2, wherein the layer thickness of the transitional layer, in which the wear-protection and running-in layers are present in graded form, has a thickness of up to 600 μm.

7. The sliding element according to claim 1, wherein the substrate is a ring of a piston ring with a diameter of 220-980 mm.

8. The sliding element according to claim 1, wherein the particle sizes of the powder fall in the range 1-100 μm.

9. The sliding element according to claim 1, wherein the carbides are embedded in a nickel-chrome matrix and exhibit a particle size of 0.5-5 μm.

10. The sliding element according to claim 1, wherein the sliding element comprises a piston ring.

11. The sliding element according to claim 1, wherein the layer thickness of the wear-protection layer is in the range of 200-600 μm.

12. The sliding element according to claim 1, wherein the layer thickness of the wear-protection layer is in the range of 300-500 μm.

13. The sliding element of claim 1, wherein the layer thickness of the running-in layer is in the range of 200-400 μm.

14. The sliding element of claim 1, wherein the layer thickness of the running-in layer is in the range of 150-300 μm.

15. The sliding element according to claim 2, wherein the layer thickness of the transitional layer, in which the wear-protection and running-in layers are present in graded form, has a thickness of up to 250 μm.

16. The sliding element according to claim 1, wherein the substrate is a ring of a piston ring with a diameter of 430-980 mm.

17. The sliding element according to claim 1, wherein the substrate is a ring of a piston ring with a diameter of 980 mm.

* * * * *